US005681070A

United States Patent [19]

Williams et al.

[11] Patent Number: 5,681,070

[45] Date of Patent: Oct. 28, 1997

[54] LOCKING MECHANISM

[76] Inventors: Gary L. Williams, 428 E. Third Avenue, Kennewick, Wash. 99336; Jesse L. Goin, Jr., 480 Kau Trail, Pasco, Wash. 99301; Patrick G. Kirby, 1010 W. Fifteenth Pl., Kennewick, Wash. 99337; John P. McKenna, Rt. 3, Box 1818, Benton City, Wash. 99320

[21] Appl. No.: 585,346

[22] Filed: Jan. 11, 1996

[51] Int. Cl.[6] ..... E05B 15/02

[52] U.S. Cl. ..... 292/341.16; 292/153; 292/201

[58] Field of Search ..... 292/341.16, 201, 292/153

[56] References Cited

U.S. PATENT DOCUMENTS

| | | | |
|---|---|---|---|
| 374,028 | 11/1887 | Woehrle | 292/341.16 |
| 2,066,277 | 12/1936 | Keil | 292/341.16 |
| 3,152,826 | 10/1964 | Smith | 292/341.16 |
| 4,015,869 | 4/1977 | Horvath | 292/341.16 |
| 4,984,835 | 1/1991 | Vadacchino et al. | 292/341.16 |
| 5,076,625 | 12/1991 | Oxley | 292/341.16 |

*Primary Examiner*—Rodney M. Lindsay

*Attorney, Agent, or Firm*—Veo Peoples, Jr.; J. William Stader; Benjamin Hudson, Jr.

[57] ABSTRACT

The invention is a motorized linkage for operating a door strike. A six volt power source, controlled by a security code, rotates a small electric motor when a proper security code is given. The motor rotates a shaft which engages a coil spring. This moves a locking cam. When a catch on the locking cam separates from the locking lever catch, the latch bolt keeper may be manipulated by a user.

4 Claims, 2 Drawing Sheets

LOCKING MECHANISM

BACKGROUND OF INVENTION

1. Field of Invention

The U.S. government has a paid-up license in this invention and the right in limited circumstances to require the patent owner to license others on reasonable terms as provided for by the terms of contract No. DE-AC06-87RL10930 awarded by the United States Department of Energy.

This invention relates to the field of electrical locks used in entry and exit passages in controlled access areas.

2. Description of Prior Art

Strikes were originally a single piece of metal plate attached to a door jamb. A hole was located in the strike to allow the lock latch bolt to extend into the hole and prevent the door from opening.

As designs evolved from mechanical to electrical controls of doors openings, two general approaches were utilized: (1) electrically-controlled locks, which are installed in the door, and (2) electrically-controlled strikes, which are installed in the door jamb. Electric strikes typically provide a latch bolt keeper mounted on a pivot. The ability of the keeper to rotate on the pivot is electrically controlled. When the keeper is free to rotate, the lock latch bolt is not retained in the door jamb and the door can be pulled open. When the keeper is not free to rotate, the lock latch bolt is retained, thus securing the door.

Previous electric strikes utilize solenoids or electric motors that require connection to the local power grid for sufficient power. The design that would accomplish this same task, powered by internally held batteries, would be an advance of the existing art due to reduced installation costs and continued operation during local power grid failures.

Two primary design requirements exist for electrically controlled strikes powered by internally held batteries. First, the design must be mechanically efficient to control mechanical parts, capable of withstanding a forced entry attempt, while utilizing a minimal amount of electrical power. Second, the design must accommodate mistimed or abusive operation by the access control system user without becoming inoperable.

An additional design criteria would be a strike that accommodates an existing electric strike device design. This facilitates retrofitting a strike of this design into a jamb prepared for a strike of older design.

The prior art illustrates a variety of patents which attempt to overcome the need for greater power consumption or damage to the linkage by improper usage.

U.S. Pat. No. 2,898,138 (Noord) relates to a power-operated latch mechanism capable of drawing a door tightly shut. A latch mechanism 10 is mounted on a door 11 while a keeper 12 is mounted on a door frame 14. Engageable with the keeper 12 is a latch bolt 15 pivotally mounted through a pin 16 on a lever 17. Lever 17 is pivotally mounted through a pin 18 and carries a roller 20 engageable with a cam 21. A spring 22 is wound around pin 18 and has one end engaging a web portion 17*a* of lever 17. Spring 22 urges roller 20 into engagement with cam 21. A motor 25 drives cam 21. As cam 21 rotates, cam 21 is retracted to move lever 17, which in turn moves bolt 15. Bolt 15 draws keeper 12 toward door 11 to pull door 11 closed. This device requires a heavy motor to ultimately drive the keeper 12.

U.S. Pat. No. 2,903,288 (Hoachim) relates to a movable latch striker mechanism. The mechanism comprises a striker element 10, power actuating means 14 for moving striker element 10 to a locked or unlocked position relative to a latch member 16, latch operated means 18 for starting operation of the power actuating means, and tension means 20 for stopping operation of the power actuating means. Again, this device requires a heavy motor or solenoid to operate the latch member.

U.S. Pat. No. 4,211,443 (Butts) relates to an electric strike assembly in a door frame with a pivotal keeper oriented for engagement by a door lock bolt for retaining a door in a locked position and releasably locked in place by a pivotal locking lever and pivotal locking cam. Similar to the Hoachim and Noord disclosures, this require a heavy motor or solenoid to function.

U.S. Pat. No. 4,917,425 (Logas) relates to a "failsafe" mechanism allowing a normally open door to be locked or unlocked when a solenoid is energized.

U.S. Pat. No. 5,199,288 (Merilainen) relates to an electromechanical door lock. A lock body 1 has an opening 4 for a dead bolt 5, which is movable between a withdrawn position by electromechanical force or by operation of a key. Lock body 1 also includes a dead-locking element 6 turnably supported on lock body 1 by a pin 8 and which is urged by a spring 7 into the locking position of dead bolt 5.

OBJECTS OF THE INVENTION

It is an object of the present invention to provide an electric, motorized door strike linkage which minimizes the use of electrical power.

It is a further object of the present invention to provide an apparatus with a linkage which minimizes the amount of load placed on the electrical motor.

It is a further object of the present invention to provide an electric, motorized entrance function, powered by internally held batteries, to an electric strike.

SUMMARY OF THE INVENTION

The present invention is an apparatus which overcomes the deficiencies in the prior art by extending the benefits of a battery-powered, electrically-controlled entrance function to an electric strike.

The device consists of a small electric motor powered by a 6-volt power supply. The power supply is controlled by a combination lock. When the electric motor is actuated by the power source, the shaft on the motor rotates. This rotation withdraws a locking cam via a coil spring. The locking cam pivots and releases the locking lever. A user is then able to open the door by applying a kinetic force to the door pull handle.

DETAILED DESCRIPTION OF THE INVENTION

Figure 1:
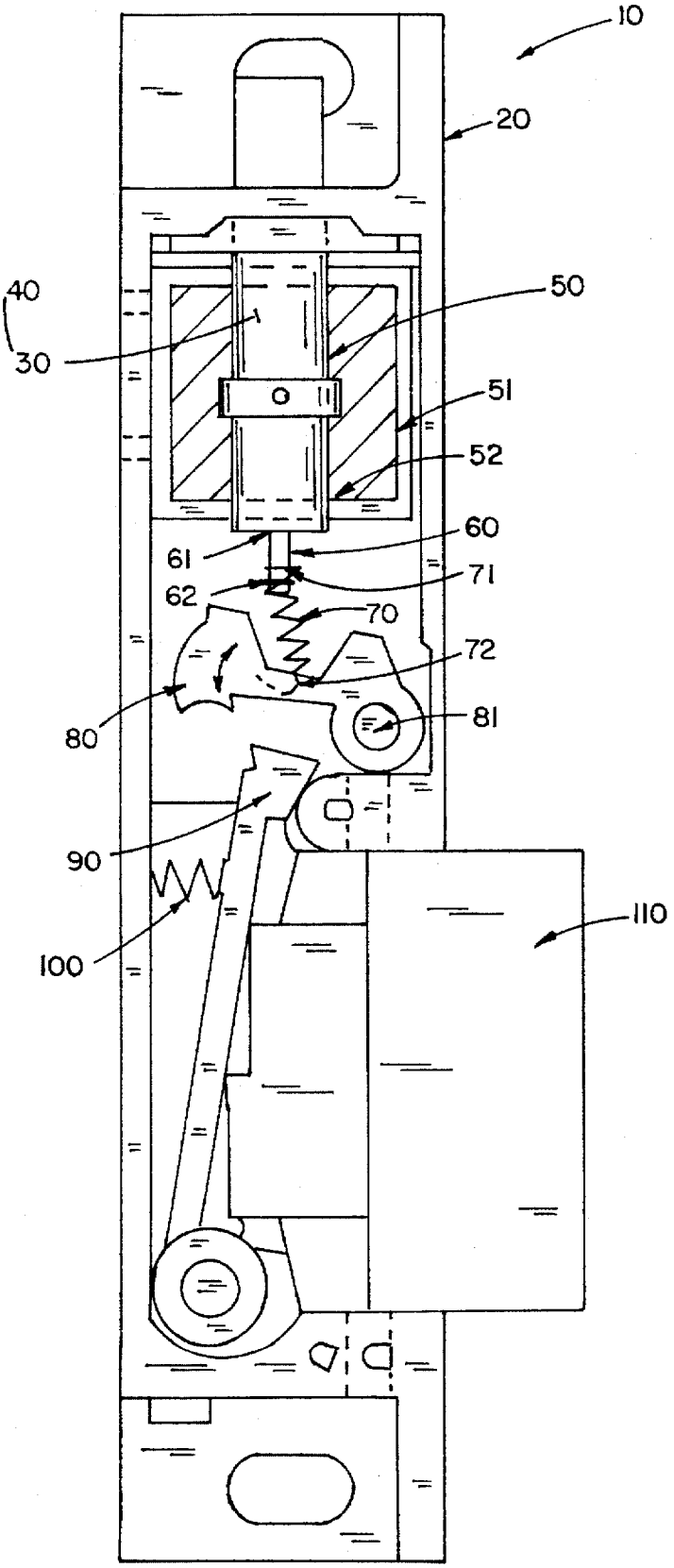
FIG. 1 is a cut-away view which illustrates the motorized linkage of the present invention.

Referring the figures, it is possible to view the various major elements constituting the present invention (10). Nearly all of the major elements are located in the housing (20). The exceptions being the power source and the combination means for inputting a security code not shown but well known to those skilled in the art (40). The power source and control means are electrically connected to the motor (50) which is located within the housing (20). Attached to the motor (50) is the shaft (60). The shaft engages a coil spring (70). The other end of the coil spring is attached to the pivoting locking cam (80). The locking cam (80) interfaces with the locking lever (90) and is actuated by the locking lever spring (100). As will be discussed below, when the locking lever (90) is properly positioned, the latch bolt keeper (110) can rotate.

A brief review of the general operation may assist the reader in grasping a more specific discussion of the elements of the invention. Typically, a user will provide a proper security code or key to the combination means (40). The proper combination will supply power from the power source (30) to an electric motor (50). The electric motor engages a coil spring (70). The coil spring (70) moves a locking cam (80), releasing the locking lever (90). The user is now able to provide the necessary kinetic energy to pull open the door.

The present invention is largely located within a rectangular, hollow housing (20). With the exception of the power source (30) and the combination means (40), all elements are located within the housing (20).

The power source (30) consists of 6 volt power source —typically either two 3-volt batteries or four 1.5-volt AA alkaline batteries. The power source (30) is controlled by a combination means (40). The combination means may be designed to allow a user to enter a security key or code. Additionally, the combination means may be set on a timer and activated only for certain periods.

The power source is electrically connected to a small electric motor (50). The motor (50) typically completes 12 rotations per command and may undergo gear reduction via an attached transmission. The motor is located inside the motor housing shaft (52) of the motor containment unit (51). This unit is positioned inside the housing (20). The motor containment unit (51) is a rectangular block which secures the motor (50) in place. The block is typically constructed from aluminum. Motors of different sizes can be placed within the housing. In order to compensate for different motor and coil spring lengths, a slot exists at the top of the housing (20).

Attached to the motor (50) is the shaft (60). The shaft (60) is rotated when the motor is energized. The shaft (60) is affixed to the motor (50) at the shaft base (61). At the shaft's opposite end is the coil spring attachment pin (62).

The attachment pin (62) engages a coil spring (70). The coil spring (70) engages the attachment pin at the attachment pin interface (71). When the shaft (60) rotates the attachment pin (62) the coil spring is rotationally 'screwed' either away or towards the motor (50). The other end of the coil spring (70) is the cam attachment interface (72). The use of a coil spring (70) and attachment pin (62) to transfer the rotation motion of the shaft (60) allows for mistimed operation and misalignments, and decreases the tolerances required in the prior art. Further this arrangement decreases the load on the motor, permitting a smaller, less powerful motor to be used. Both of these items decrease the cost of the motor while increasing the life expectancy of the motor and batteries. The coil spring performs a dual function. When in the locked position, the coil spring is a compression spring which secures the locking cam in an engaged position. When in the unlocking role, the coil spring performs the function of a worm gear, transferring rotational forces into linear forces.

Figure 3:
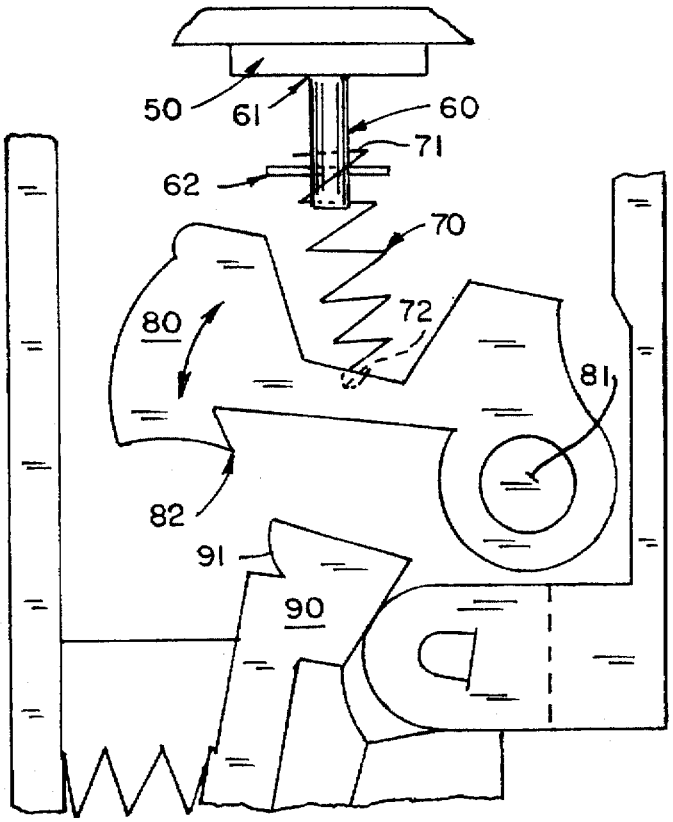
FIG. 3 is an expanded cut-away view of the locking cam in the 'unlocked' position.

The cam attachment interface (72) is affixed to the side of the locking cam (80). Typically, a screw can be used. The locking cam (80) has a locking cam pivot (81) and a locking cam catch (82). The locking cam (80) has been modified over the prior art to allow for sufficient clearance for the coil spring (70) and shaft (60). The locking cam catch interfaces with the locking lever catch (91) located on the locking lever (90). The locking lever is actuated by the locking lever spring (100). When the locking cam catch (82) and locking lever catch (91) are no longer in contact (as illustrated in FIG. 3), a user is able to rotate the latch bolt keeper (110) by pulling on the door.

Figure 2:
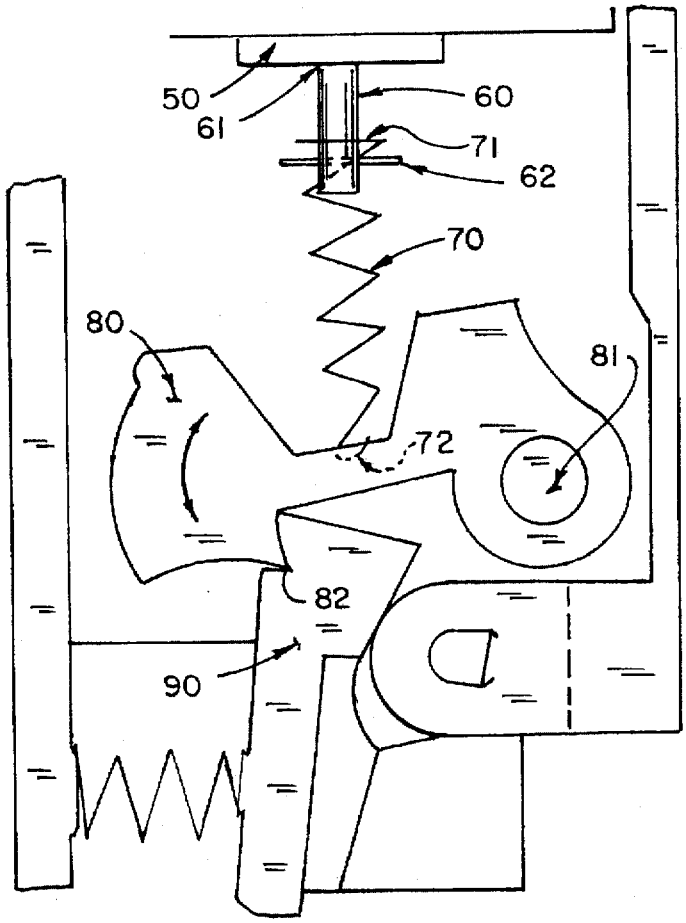
FIG. 2 is an expanded cut-away of the locking cam in the 'locked' position.

The present invention operates when the correct security code is inserted into the combination means (40). This allows the power source (30) to energize the electric motor (50). The electric motor (30) rotates the shaft (60). The attachment pin (62) which is affixed to the shaft, 'draws in' the coil spring (70). This moves the locking cam (80) from the closed position (FIG. 2) to the open position (FIG. 3). Once the locking cam catch (82) and the locking lever catch (91) are separated (FIG. 3) the latch bolt keeper (110) is free to rotate, thus releasing the door. The use of the electric motor to only withdraw the locking cam (80) and by using the kinetic force of the user to actually move the latch bolt keeper greatly diminishes the need for larger motors or solenoids. This negates the requirement to wire provide greater power sources to the door.

It will be obvious to those skilled in the art that various changes may be made without departing from the scope of the invention and the invention is not to be considered limited to what is illustrated in the drawings and described in the specification.

What is claimed is:

1. A locking mechanism, comprising:

a) a housing;

b) a motor containment unit, affixed within the housing, said unit having a motor housing shaft, therein;

c) a motor inserted in the motor housing shaft;

d) a motor drive shaft with a first end rotationally driven by the motor and a second end having a coil spring attachment pin affixed;

e) a coil spring with a first end rotationally driven by the attachment pin and a second end affixed to a locking cam;

f) said locking cam with a locking cam catch;

g) a locking lever with a locking lever catch, said lever pivotly connected to the housing, said locking lever catch intermittently interfacing with the locking cam catch; and h) a latch bolt keeper rotationally affixed within the housing and intermittently interfacing with the locking lever wherein the motor drives the motor drive shaft rotating the attachment pin and coil spring causing the locking cam to release the locking lever from the locking lever catch unlocking the mechanism.

2. The locking mechanism defined in claim 1, wherein said motor containment unit is a rectangularly shaped block of aluminum with said motor housing shaft therein.

3. The locking mechanism defined in claim 2, wherein the motor is electrically powered by a 6-volt battery pack.

4. The locking mechanism defined in claim 3, wherein the power source is selected from a group consisting of two 3-volt lithium batteries and four 1.5 volt AA alkaline batteries.

* * * * *